US006709274B2

(12) United States Patent
Lazaro, Jr. et al.

(10) Patent No.: US 6,709,274 B2
(45) Date of Patent: Mar. 23, 2004

(54) AIRCRAFT HIGH PERFORMANCE EXTERNAL FIXED AND GROUND SUPPLY FREE PLUG CONNECTORS AND ITS ASSEMBLY

(75) Inventors: Luis J. Lazaro, Jr., Shoreline, WA (US); David P. Carter, Lake Forest, CA (US)

(73) Assignee: The Boeing Company, Seattle, WA (US)

( * ) Notice: Subject to any disclaimer, the term of this patent is extended or adjusted under 35 U.S.C. 154(b) by 76 days.

(21) Appl. No.: 09/923,858

(22) Filed: Aug. 7, 2001

(65) Prior Publication Data

US 2003/0032336 A1 Feb. 13, 2003

(51) Int. Cl.[7] ..... H01R 23/26
(52) U.S. Cl. ..... 439/34; 439/290; 439/680
(58) Field of Search ..... 439/680, 34, 35, 439/346, 364, 144, 143, 142, 310, 578, 579, 580; 180/65.1; 296/97.22

(56) References Cited

U.S. PATENT DOCUMENTS 4,302,066 A * 11/1981 Newman et al. ..... 339/82
5,174,777 A * 12/1992 Carter ..... 439/290
5,556,284 A * 9/1996 Itou et al. ..... 439/34
5,791,932 A * 8/1998 Hazenfratz ..... 439/347
6,206,577 B1 * 3/2001 Hall, II et al. ..... 385/53

OTHER PUBLICATIONS

Phillips Catalog, section. 2, p.2.*

* cited by examiner

*Primary Examiner*—Alexander Gilman
(74) *Attorney, Agent, or Firm*—Conrad O. Gardner

(57) ABSTRACT

An aircraft fixed receptacle connector and a ground supply free plug connector used in commercial and military aircraft. This high performance external power connector is capable of operating in the 120 KVA rating to meet the electrical load requirement on today's newer, larger, and higher capacity aircraft. An array of high amperage power contacts and conventional pin and socket relay contacts are used.

3 Claims, 4 Drawing Sheets

AIRCRAFT HIGH PERFORMANCE EXTERNAL FIXED AND GROUND SUPPLY FREE PLUG CONNECTORS AND ITS ASSEMBLY

BACKGROUND OF THE INVENTION

The present invention relates to aircraft connectors for ground electrical supplies. More particularly, the invention relates to an aircraft fixed connector (receptacle) and ground supply free connector (plug) used on commercial and military aircraft. With newer aircraft having higher capacity load, ground power supply and aircraft multiple socket hook-ups are insufficient and inefficient.

When a commercial aircraft is docked at the airport and it's self generating electrical power is shut off, the aircraft is plugged into the airport ground power system. Stated differently, a ground power cart can be connected to the airport power supply system with its ground supply free connector attached to the aircraft fixed connector which is usually mounted and located at the bottom of the exterior forward nose cargo area of the aircraft. Prior art aircraft power connector coupling is basically maintained through the physical engagement between the electrical contact pins on the aircraft's fixed connector and the electrical contact sockets on the ground supply's free connector. This coupling interconnection between the aircraft power receptacle and ground power plug is the major cause of failure. The heavy weight of the ground power plug pulling down on the electrical engagement between the pin and socket contacts may cause arcing when power is on. This condition coupled to the frequency of coupling and uncoupling on these connectors will result in eventual electrical breakdown. Other contributors to aircraft power connectors failures are: a) a damaged or worn receptacles or plugs can cause damage to aircraft and ground power units; b) the ground power plug could well be connected to several hundred aircraft receptacles during its life; c) no inspection of either aircraft receptacle or ground power plug before usage; d) no action and/or process to identify aircraft receptacle or ground power plug which may have damaged other aircraft power connectors; e) the environment in which the connectors are used cannot be controlled; f) the aircraft power connectors require considerable force to couple, resulting in incomplete coupling, particularly where this requires lifting the ground power plug above shoulder height; g) the staff or crew connecting the aircraft power connectors may have no electrical knowledge; and h) the standards to which the aircraft power connectors are maintained throughout the world can vary significantly. Replacement of either the aircraft fixed connector and/or ground supply free connector is a significant revenue loss to the airlines and airport.

BRIEF SUMMARY OF THE INVENTION

The present invention in an illustrative embodiment describes 120 KVA aircraft power connectors using a hermaphroditic high amperage power contract, e.g., as shown in U.S. Pat. No. 5,174,777 to Carter, issued Dec. 29, 1992. The present embodiment supplies the electrical ground power needs on the newer, larger and higher capacity load aircraft. Furthermore, the hereinafter described aircraft power connectors ensure full electrical coupling and are self-attaching, which facilitates assembly of ground supply free connectors onto aircraft fixed connectors.

It is an object of this invention to overcome the herein above described deficiencies and disadvantages of the prior art.

It is another object of this invention to provide a new aircraft fixed connector (receptacle) and ground supply free connector (plug) which are: a) capable of providing a 120 KVA ground power supply with a reliable high electrical bearing interface; b) electrically and mechanically engaged when coupled; c) robust in construction; d) capable of withstanding heavy mechanical shocks and hard wear in use; and e) equipped with a positive coupling arrangement which will release automatically with a simple pull on a wire lanyard without damage to the aircraft fixed connector or its mounting.

A further object of this invention is to provide aircraft power connectors which comprise four hermaphroditic high amperage power contacts and two conventional relay contacts and receptacle and plug housing and its components wherein the aircraft fixed connector contains an integral mounting flange with four specially placed panel mounting holes. Also, this integral mounting flange contains another strategically placed hole with provisions for a slide latch fastener. A wire lanyard is attached to the slide latch fastener for releasing the latching pin on the ground supply free connector. The housing proximal end has an extended shroud designed to protect the mating ends of the electrical contacts and is constructed with a keyway. Additionally, boss like creepage barrier tubes independently surround each of the four hermaphroditic high amperage power contacts. Furthermore, attached to the electrical contacts but dielectrically insulated from each other are wire terminal studs with nut, washer and lockwasher.

The ground supply free connectors has an extended male boss which surrounds and protects the mating ends of the electrical contacts and has provisions for accepting the boss like creepage barrier tubes surrounding the hermaphroditic high amperage power contacts contained in the fixed connector. This extended male boss which forms part of the ground supply free connector has a matching key which is intended to allow one way assembly between the ground supply free connector and the aircraft fixed connector. This facilitates and eases the considerable force and sometimes blind mate condition when coupling the ground supply free connector onto the fixed connector. An environmentally sealing cable clamp or backshell having a male engagement thread is coupled onto the female thread provided at the distal end of the connector housing. Additionally, a reinforcing integral boss is strategically placed on the housing which accepts an extended but fixed latch pin. A wire lanyard is attached to the sliding latch that is part of the aircraft fixed connector that accepts the latch pin of the ground supply free connector. It can be seen that the mated integrity of the aircraft power connectors is maintained by the latch pin being captivated by the sliding latch. When it becomes necessary to unplug the ground supply free connector, a simple pull on the wire lanyard opens the sliding latch and the aircraft power connectors can be separated. It can also be seen that ground personnel on occasion may forget to disconnect the ground supply free connector as the aircraft begins its taxi to the runway, causing major damage to the ground power cart. The present invention has built-in contingency for releasing the ground supply free connector to the ground when the wire lanyard becomes taut. Another advantage of the present invention is that, realizing the physical abuse and environmental conditions that are normally inherent when using the ground supply free connector, a metal protective cover can be installed to lengthen its durability and life usage. This feature contains a set of plug face covers and trap like doors that open. The doors fully open prior to engagement on the electrical contacts of the aircraft power connectors.

A still further object of the present invention is to provide a ground supply free connector having an environmental protective cover which automatically open when being coupled to the aircraft fixed connector and closes when decoupled.

It is also an object of this invention to provide aircraft power connectors with replaceable contacts (when damaged or worn out) such that the ground supply free connector cable can be reused or aircraft fixed connector repaired thereby saving labor and time.

One embodiment of the present invention is the receptacle connector housing having an extended shroud with boss like creepage barrier tubes and keyway to engage an envelope of plug connector housing having male boss and key. Specifically, boss like creepage barrier tubes and male boss are constructed to protect the high amperage power contacts. Another embodiment is the full mechanical coupling between the aircraft fixed receptacle connector and ground supply free plug connector as provided by having the latch pin in the plug connector in a locked position within the receptacle connector slide latch fastener. These embodiments ensure full electrical contact engagement, user friendly assembly between plug and receptacle connectors, and eliminate prior art short life cycle on the high amperage power contacts. A wire release lanyard is provided in the slide latch fastener to decouple the external power connectors. Additionally, a metal housing comprising a set of doors attached to a set of hinge springs which are connected to a slide link protects ground supply free plug connector from adverse usage and extreme weather conditions. The set of doors is closed when the plug connector is at its uncoupled condition and is open when the plug connector is being coupled to the aircraft fixed receptacle connector. Movement on these doors is initiated by a spring-loaded actuator pin which is mounted in the face of the plug connector. An environmentally sealing backshell threadedly connected on the distal end of the ground supply free plug connector body or housing allows power and relay contacts to be replaced when necessary. Another embodiment of the present invention is the power and relay electrical contacts are replaceable. This property is non-existent in the prior art aircraft external power connector.

DETAILED DESCRIPTION OF THE INVENTION

Figure 1:
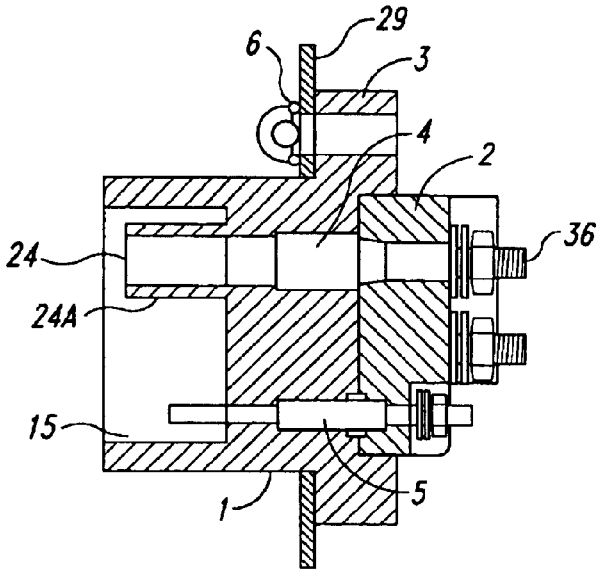
FIG. 1 is a cross-sectional view of the aircraft fixed receptacle connector illustrating both the hermaphroditic high amperage power contact and the conventional relay contact attached to its wire terminal stud and accessory. Included also is the slide latch fastener.
Figure 2:
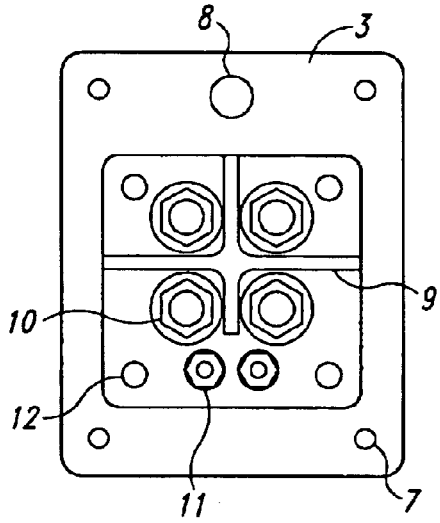
FIG. 2 is a rear (face) view of the aircraft fixed receptacle connector showing the wire terminating studs and its accessory for the four power and two relay contacts, its integral mounting flange with specially located holes for panel mounting, and the slide latch fastener.
Figure 3:
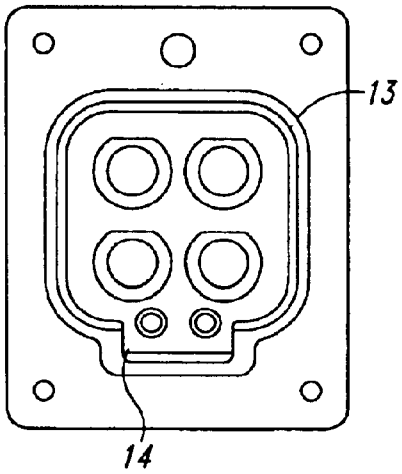
FIG. 3 is a front (face) view of the aircraft fixed connector illustrating its extended shroud construction and a keyway portion thereof.

For this description, a 120 KVA aircraft high performance external fixed and ground supply free power connector and its assembly exemplifying the preferred embodiments of the present invention is detailed in FIGS. 1–10. As shown in FIGS. 1–3, the aircraft fixed receptacle connector 1 includes a mating face 24 with extended creepage barrier tubes 24A. Surrounding and protecting this mating face is an extended shroud 13 that projects beyond the distal ends of the hermaphroditic high amperage power contacts 4 and conventional relay contacts 5. Within this extended shroud 13 and located at the bottom end is a keyway 14 that is smaller in width than the full length of the extended shroud 13 affording it to be nonsymmetrical. Built into this keyway 14, at its most forward end, is a raised catch 15 which is adaptable to fit into a recess 23 within the boss 21 of the mating ground supply free plug connector 16. As shown in FIG. 2, the aircraft fixed receptacle connector 1 contains an integral mounting flange 3. Molded or drilled into the integral mounting flange 3 are four panel mounting holes 7 that are located in the outer corner of the flange 3 and these holes 7 accept screws which allow the aircraft fixed receptacle connector 1 to be bolted to an aircraft panel 29. Also molded or drilled into the integral mounting flange 3 is a larger hole 8. Attached onto the aircraft panel 29 is a slide latch fastener 6 that is placed in front of larger hole 8. Attached onto the aircraft panel 29 is a slide latch fastener 6 that is placed in front of larger hole 8. Attached onto the aircraft panel 29 is a slide latch fastener 6 that is placed in front of larger hole 8. This larger hole 8 accepts the latch pin 18 contained in the ground supply free plug connector 16. Within the embodiment of the aircraft fixed receptacle connector 1 and referred to earlier are four 120 KVA hermaphroditic high amperage power contacts 4 and two conventional relay pin contacts 5. These power contacts 4 and relay contacts 5 are captivated within the aircraft fixed receptacle connector 1 by a rear dielectric plate 2 which is held by four screws 12. On the distal ends of the power contacts 4 and relay contacts 5 are threaded wire terminal studs 36 which penetrate a designated array of holes molded into the rear dielectric plate 2. Molded onto the back of the rear dielectric plate 2 is a web-like separator 9. This ensures electrical interference when wired terminal lugs (not shown) are connected to the threaded terminal studs 36 of the power contacts 4 and relay contacts 5 using the washer and lockwasher 10 and hex nut 11.

Figure 4:
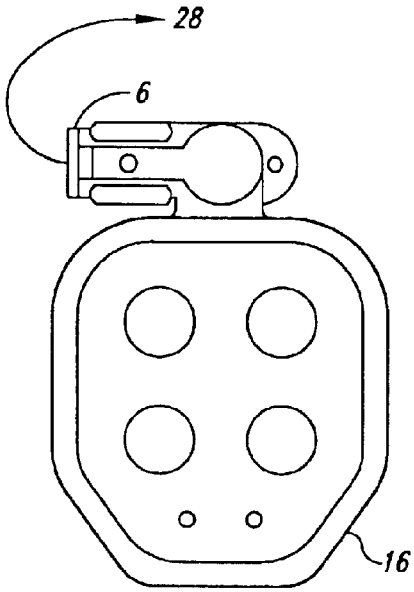
FIG. 4 is a rear view of cable terminal end of the ground supply free plug connector and a detail view of the slide latch fastener with the latch pin in a coupled position plus a depiction of the wire lanyard mechanism in accordance with the present invention.
Figure 5:
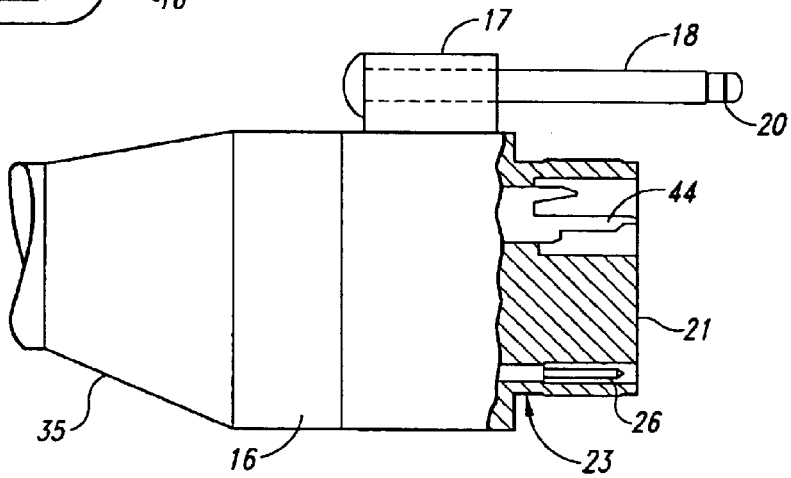
FIG. 5 is a partly sectional side view of the ground supply free plug connector showing the latch pin, environmentally sealing backshell and the electrical contacts.
Figure 6:
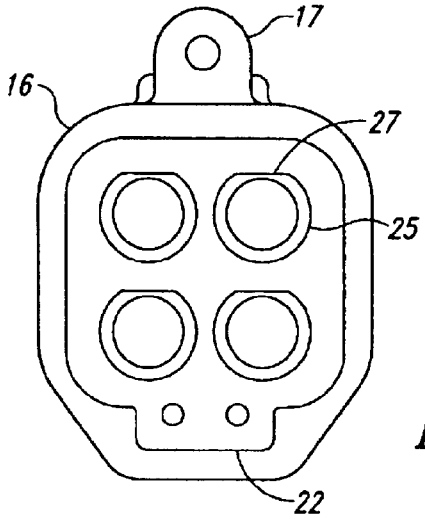
FIG. 6 is a front (face) view of the ground supply free plug connector showing the plurality of electrical contacts and its extended, keyed, male boss in accordance with the present invention.
Figure 7:
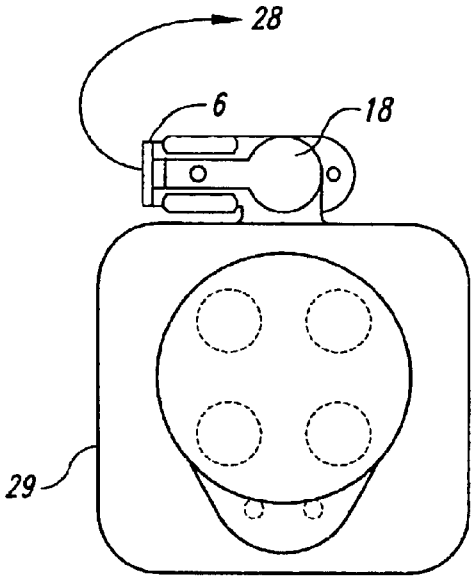
FIG. 7 is similar to FIG. 4, illustrating the metal protective cover housing.
Figure 8:
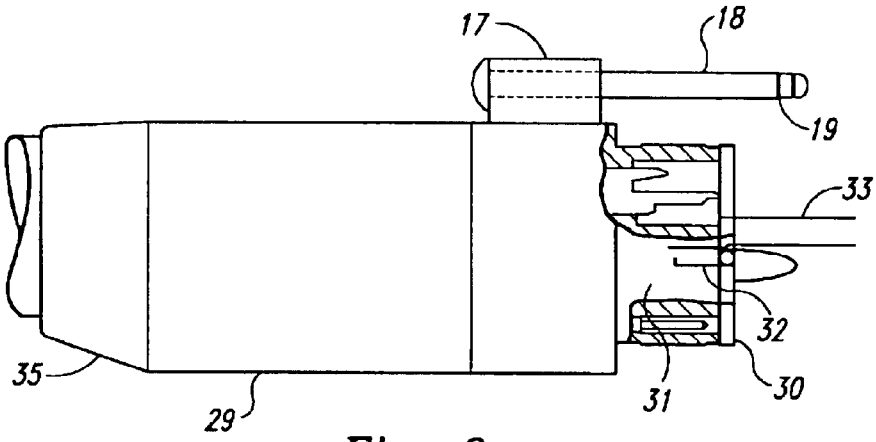
FIG. 8 is similar to FIG. 5 but included is FIG. 8A, a cutaway partial top view, illustrating the mechanism of the spring loaded plug face covers with its trap like doors connected to hinge springs in accordance with the present invention.
Figure 8A:
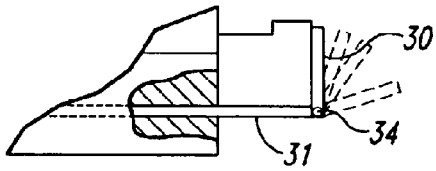
Figure 9:
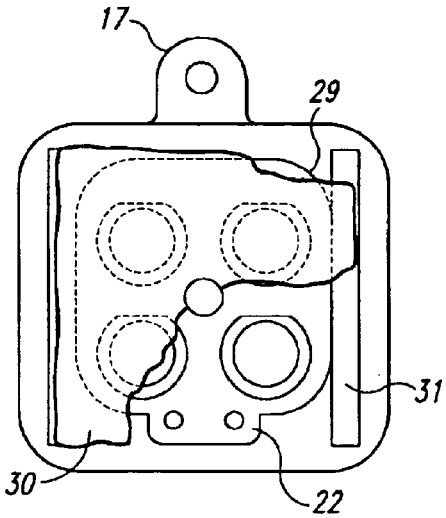
FIG. 9 is similar to FIG. 6 but with metal protective cover over the engaging face of the ground supply free plug connector.
Figure 10:
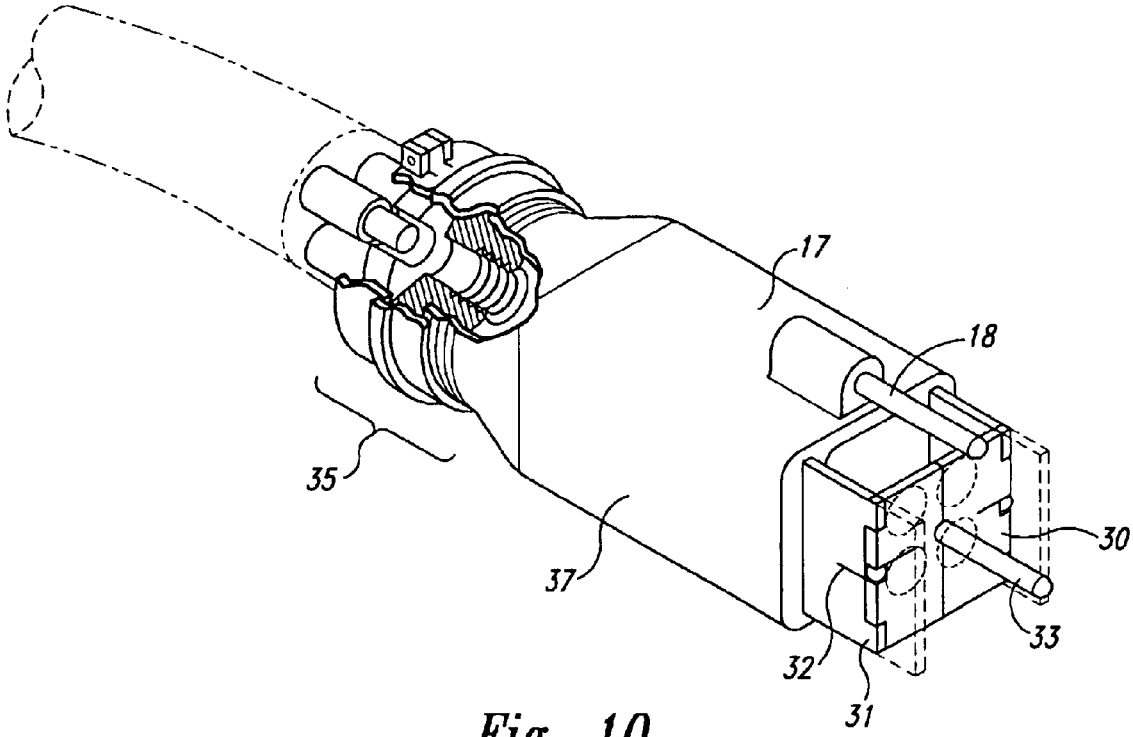
FIG. 10 is an isometric view of the ground supply free plug connector showing the metal protective cover, spring loaded actuator pin, latch pin
Figure 10A:
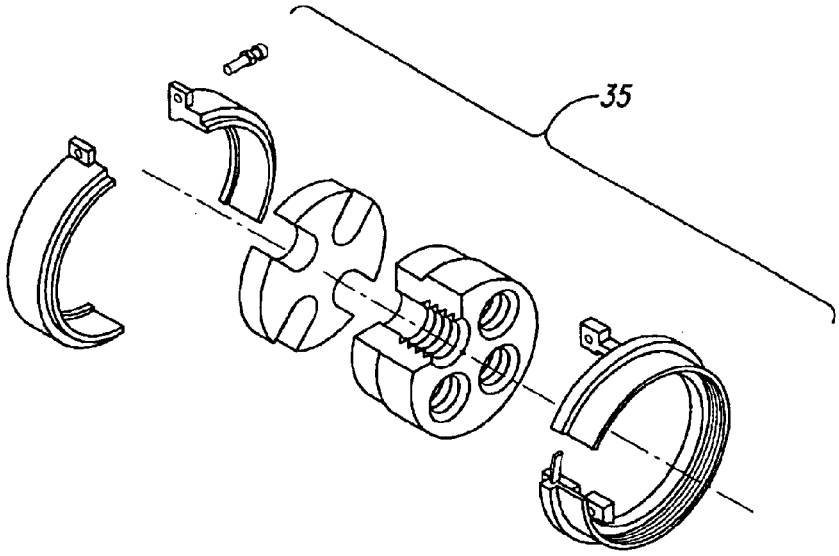
FIG. 10A is a cutaway detailed view of the environmentally sealing backshell.

As can be seen from FIGS. 4–6, the present embodiment of the invention shows a 120 KVA ground supply free plug connector 16 having an extended male boss 21 which surrounds and protects the mating ends of the power contacts 4 and relay contacts 5, an environmentally sealing backshell 35 and a fixed latch pin 18. This male boss 21 is configured in a manner which affords a slight interference fit into the extended shroud 13 of the aircraft fixed receptacle connector 1. At the rear bottom of the male boss 21 is a small cavity 23 that accepts and captures the catch 15 of the extended shroud 13. Located also at the bottom of the male boss 21 is a key 22 with a width smaller than its full length. This male key 22 engages the keyway 14 in the aircraft fixed receptacle connector 1. Molded on the uppermost location of the ground supply free plug connector 16 is a reinforce boss 17 that accepts the latch pin 18. The ground supply free plug connector is coupled to the aircraft fixed receptacle connector 1 and aircraft panel 29. A wire lanyard 28 is connected to the slide latch fastener 6 that is mounted onto the aircraft panel 29 which engages in a coupled position the latch pin 18 via a machined-in groove 20 at the front end of the latch pin 18. Within the ground supply free plug connector 16 are four hermaphorditic high amperage power contacts 4A and two conventional relay socket contacts 26 dimensionally arranged to couple with the power contacts 4 and relay pin contact 5 contained in the aircraft fixed receptacle connector 1. Surrounding the four power contacts 4A at their distal, engaging ends are holes 25 with a flat section 27. These holes 25 accept the creepage barrier tubes 24A that form part of the mating face 24 of the aircraft fixed receptacle connector 1.

As described above and seen in FIGS. 7–10, the ground supply free plug connector 16 includes the male boss 21, cavity 23, key 22, boss 17, latch pin 18 with groove 20, plurality of power 4A and relay socket 26 contacts, holes 25 with a flat section 27 and the environmentally sealing backshell 35. This embodiment construction shows a full metal housing 37 designed to withstand physical abuse and extreme weather conditions. This full metal housing 37 totally surrounds the basic dielectric body of the ground supply free plug connector 16. Additionally, the power 4A and relay 26 contacts can be protected from the elements described with a metal protective cover having a set of doors 30. Attached to each door 30 is a hinge spring 32, both connected to a slide link 31. Centrally located at the seam of the doors 30 is a semicircular hole through which extends a spring-loaded actuator pin 33. The spring-loaded actuator 33 is centrally mounted onto a horizontal bar which connects the two side plates of the slide link 31. When the ground supply free plug connector 16 is coupled to the aircraft fixed receptacle3 connector 1, the flat portion of the mating face 24 of the aircraft fixed receptacle connector engages the spring-loaded actuator pin 33 causing it to retract into the basic dielectric body of the ground supply free plug connector 16. As the spring-loaded actuator pin 33 starts to move back, the slide link 31 simultaneously pulls back, opening the doors 30. This described movement is completed prior to the coupling of the power contact 4 and relay pin contact 26 in the ground supply free plug connector 16. At this point it can be readily understood that the male boss 21 of the ground supply free plug connector 16 enters the extended shroud 13 of the aircraft fixed receptacle connector 1. Subsequently, latch pin 18 enters hole 8 until slide latch fastener 6 snaps into the groove 20 located at the front end of latch pin 18. In parallel, catch 15 locks into the cavity 23 as the key 22 engages the keyway 14. At the completion of the described parts movement, the aircraft fixed receptacle connector 1 and the ground supply free plug connector 16 are fully coupled. This condition ensures that the power contacts 4 and 4A and relay contacts 5 and 26 are in full electrical engagement. When it is necessary to uncouple the ground supply free plug connector 16 from the aircraft fixed receptacle connector 1, lanyard 28 is pulled and activates slide latch fastener 6 which free up the groove 20 on latch pin 18. As the ground supply free plug connector 16 separates from the aircraft fixed receptacle connector 1, spring-loaded actuator pin 33 ejects forward to is normal position. Simultaneously, slide link 31 also moves forward closing the doors 30 and enables the hinge springs 32 to extend to its protracted position keeping the doors 30 closed. Defective power contacts 4 and 4A and relay contacts 5 and 26 can be easily replaced. To gain access to the defective power and/or relay contacts, screws 34 are removed, allowing the environmentally sealing backshell 35 to be threadedly removed from the ground supply free plug connector housing.

What is claimed is:

1. An aircraft high performance external power connector and its assembly for use at ground electrical supplies, said power connectors and its assembly comprising:

an aircraft fixed receptacle connector having a multiplicity of 120 KVA hermaphrodite power contacts and relay socket contacts, said power contacts independently surrounded by boss like creepage barrier tubes;

a ground supply free plug connector having (i) a body portion and a connection portion, said body portion holding and retaining said multiplicity of 120 KVA hermaphrodite power contacts and conventional relay pin contacts, and said connection portion having an environmentally sealing cable clamp or backshell threadedly connected onto said body portion;

(ii) a reinforced boss which houses a latch pin with a circumferentially machined groove located at its front end; and (iii) a full metal housing around a dielectric body portion, said full metal housing comprising of a set of doors attached to a set of hinge springs which are connected to a slide link, (iv) a spring-loaded actuator pin which is centrally located at the seams on said doors that controls the forward and rearward movement slide link of a metal housing.

2. A ground supply free plug connector according to claim 1, wherein said slide link opens and closes said doors.

3. A ground supply free plug connector according to claim 2, wherein said slide link moves in a forward direction causing hinge springs to extend to their protracted position keeping said set of doors closed.

* * * * *